US007750879B2

(12) United States Patent
Kawaura

(10) Patent No.: US 7,750,879 B2
(45) Date of Patent: Jul. 6, 2010

(54) IMAGE DISPLAY DEVICE CAPABLE OF SHIFTING A DATA LINE DESTINATION

(75) Inventor: Hideaki Kawaura, Kanagawa (JP)

(73) Assignee: Sony Corporation, Tokyo (JP)

( * ) Notice: Subject to any disclaimer, the term of this patent is extended or adjusted under 35 U.S.C. 154(b) by 715 days.

(21) Appl. No.: 11/679,525

(22) Filed: Feb. 27, 2007

(65) Prior Publication Data

US 2008/0266223 A1 Oct. 30, 2008

(30) Foreign Application Priority Data

Mar. 2, 2006 (JP) ..... 2006-055691

(51) Int. Cl.
*G09G 3/36* (2006.01)

(52) U.S. Cl. ..... 345/88

(58) Field of Classification Search ..... 345/88
See application file for complete search history.

(56) References Cited

U.S. PATENT DOCUMENTS

2002/0080109 A1* 6/2002 Nagata et al. ..... 345/92
2004/0036702 A1* 2/2004 Kageyama et al. ..... 345/690
2004/0082090 A1* 4/2004 Hatano et al. ..... 438/30
2006/0007094 A1* 1/2006 Kang et al. ..... 345/98
2006/0028426 A1* 2/2006 Hiratsuka ..... 345/103

FOREIGN PATENT DOCUMENTS

JP 08-184928 7/1996
JP 09-281599 10/1997
JP 2003-015581 1/2003

* cited by examiner

*Primary Examiner*—Richard Hjerpe
*Assistant Examiner*—Andrew Schnirel
(74) *Attorney, Agent, or Firm*—Sonnenschein Nath & Rosenthal LLP

(57) ABSTRACT

An image display device including: a pixel group formed by arranging a plurality of pixels; a driver circuit configured to supply an image signal to each pixel in the pixel group; and a switch circuit configured to shift a destination to which the image signal is supplied in a unit of a pixel pitch by circuit switching for bus lines for transmitting the image signal from the driver circuit to each pixel in the pixel group.

5 Claims, 5 Drawing Sheets

IMAGE DISPLAY DEVICE CAPABLE OF SHIFTING A DATA LINE DESTINATION

CROSS REFERENCES TO RELATED APPLICATIONS

The present invention contains subject matter related to Japanese Patent Application JP 2006-055691 filed in the Japanese Patent Office on Mar. 2, 2006, the entire contents of which being incorporated herein by reference.

BACKGROUND OF THE INVENTION

1. Field of the Invention

The present invention relates to an image display device and an image display apparatus that display an image by a pixel group formed by a plurality of pixels.

2. Description of the Related Art

Projection type video display devices, for example, that display a picture using a plurality of image display devices employ a system referred to as a three-panel type system using three image display devices. This method separates light into three colors of red, green, and blue, changes the luminance of each of the colors by the image display devices, and thereafter synthesizes the results by an optical block such as a prism, whereby a desired picture is obtained.

Because an image display device is provided for each of the colors of red, green, and blue, this method has advantages of excellent color reproducibility and high brightness. On the other hand, the method has disadvantages in that circuitry is complex because three display devices may be required and registration of the display devices for the respective colors may be required.

The registration of the image display devices is necessary to display an image formed in red, an image formed in green, and an image displayed in blue such that the image formed in red, the image formed in green, and the image displayed in blue are superimposed on each other. The image display devices need to be registered with each other precisely with an accuracy of about one pixel. When the registration is not performed with high precision, a picture with a color shift is displayed, and therefore it is difficult to achieve high-quality picture display.

One pixel in an image display device is very small, and can be as small as a few μm. It is therefore very difficult to register the image display devices. Since the pixel size of liquid crystal display devices used in a projection type liquid crystal display device tends to be decreased, it is considered that the registration will become increasingly difficult in the future. Furthermore, even when the precision at the time of attachment is high, the attachment position can be slightly shifted with the passage of time.

As described above, the registration of devices may require a precision with which the devices are bonded to an optical block such as a prism within a displacement of one pixel and an attachment structure that prevents a secular change in the attachment position of the display devices. Japanese Patent Laid-Open No. Hei 8-184928 discloses a structure for registering image display devices in a projection type video display device in the past.

SUMMARY OF THE INVENTION

In actuality, however, it is very difficult to attach image display devices to a prism with high precision. In addition, a positional displacement of a display device may occur after the attachment. It is thus difficult to improve yield. In particular, it is difficult to correct a positional displacement after the attachment once the image display devices have been fixed, so that the positional displacement leads directly to a product defect. Existing technology deals with such a problem by for example interchanging signals in a signal processing system in advance. However, this increases burdens in terms of circuitry and cost because of for example needs for exchange of signals between drivers necessary at a display position and for an additional driver for outermost display pixels.

The present invention has been made to solve such problems. According to an embodiment of the present invention, there is provided an image display device including: a pixel group formed by arranging a plurality of pixels; a driver circuit configured to supply an image signal to each pixel in the pixel group; and a switch circuit configured to shift a destination to which the image signal is supplied in a unit of a pixel pitch by switching bus lines for transmitting the image signal from the driver circuit to each pixel in the pixel group.

In addition, according to an embodiment of the present invention, there is provided an image display apparatus for forming one image by superimposing images of a plurality of image display devices upon each other, wherein the image display devices each include a pixel group formed by arranging a plurality of pixels, a driver circuit configured to supply an image signal to each pixel in the pixel group, and a switch circuit configured to shift a destination to which the image signal is supplied in a unit of a pixel pitch by switching bus lines for transmitting the image signal from the driver circuit to each pixel in the pixel group.

The image display device is a device that makes display by supplying a signal to each pixel, such as a reflective type liquid crystal display device, a transmissive type liquid crystal display device, an organic EL display device, a plasma display device, a digital micromirror device. The image display apparatus is a display apparatus such as a projection type display apparatus that forms one image by superimposing images of a plurality of image display devices upon each other.

The present invention uses a switch circuit configured to shift a destination to which the image signal is supplied in a unit of a pixel pitch by circuit switching for bus lines for transmitting the image signal from the driver circuit to each pixel in the pixel group. It is therefore possible to shift the position of a displayed image in a unit of a pixel pitch with only a simple circuit configuration without performing a special signal operation by the driver circuit.

Hence, according to the present invention, it is possible to change the position of video display easily without relying on a signal processing system. This eliminates the existing needs for exchange of signals between drivers and for an outermost driver, thus making it possible to reduce the number of man-hours and cost.

DETAILED DESCRIPTION OF THE PREFERRED EMBODIMENT

Figure 1:
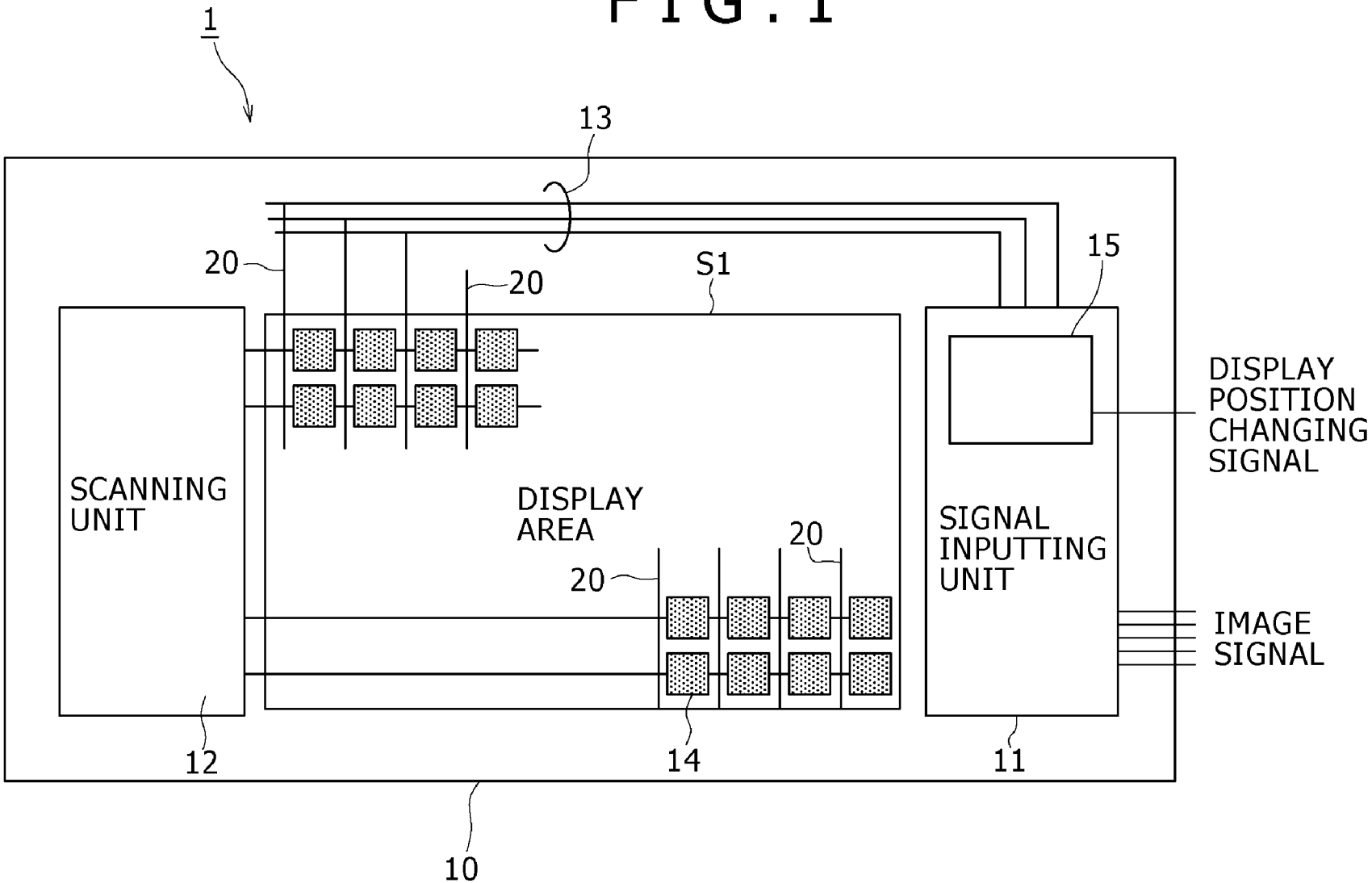
FIG. 1 is a schematic plan view of assistance in explaining a liquid crystal display device as an example of an image display device according to an embodiment of the present invention.

A preferred embodiment of the present invention will hereinafter be described with reference to the drawings. FIG. 1 is a schematic plan view of assistance in explaining a liquid crystal display device as an example of an image display device according to the present embodiment. The liquid crystal display device 1 is a reflective type liquid crystal device. The liquid crystal display device 1 includes: a pair of substrates, one of the substrates being superposed on the other with a predetermined gap therebetween, and the gap being filled with a liquid crystal; a plurality of pixels 14 (pixel group) provided in a region filled with the liquid crystal; a driver circuit (a signal inputting unit 11 and a scanning unit 12) for driving the plurality of pixels 14; and data buses 13 for supplying an image signal from the signal inputting unit 11 to each pixel column.

Since FIG. 1 is a schematic plan view, the driving side substrate 10 of the pair of substrates is shown. The reflective type liquid crystal device uses a semiconductor substrate of silicon or the like (including a substrate having a semiconductor film formed thereon) as the driving side substrate 10. Switching elements for driving the liquid crystal and reflecting electrodes for applying a voltage from the switching elements to the liquid crystal are formed in the form of a matrix by a semiconductor process technology. An area where the reflecting electrodes are formed is a video display area S1 for displaying video by the liquid crystal. In addition, the scanning unit 12 for driving the switching elements and the signal inputting unit 11 are formed on the periphery of the display area S1 of the driving side substrate 10. Incidentally, a configuration may be employed in which the driver circuit is disposed on the outside and only signals are input via a flexible cable or the like.

A glass substrate is used as a substrate opposed to the driving side substrate 10. A transparent electrode is formed uniformly on the glass substrate, and is used as a counter electrode opposed to the reflecting electrodes of the driving side substrate 10. The driving side substrate 10 and the glass substrate are laminated as the pair of substrates via a sealing agent not shown in the figure. A gap between the substrates, which gap is formed by the thickness of the sealing agent, is filled with the liquid crystal.

The liquid crystal display device 1 as image display device according to the present embodiment includes a switch circuit 15 for changing the connection of signal lines to data lines 20 arranged within the device. The switch circuit 15 changes positions to which signals are sent, so that a display position can be changed from an original position by a unit of a pixel pitch.

Figure 2A:
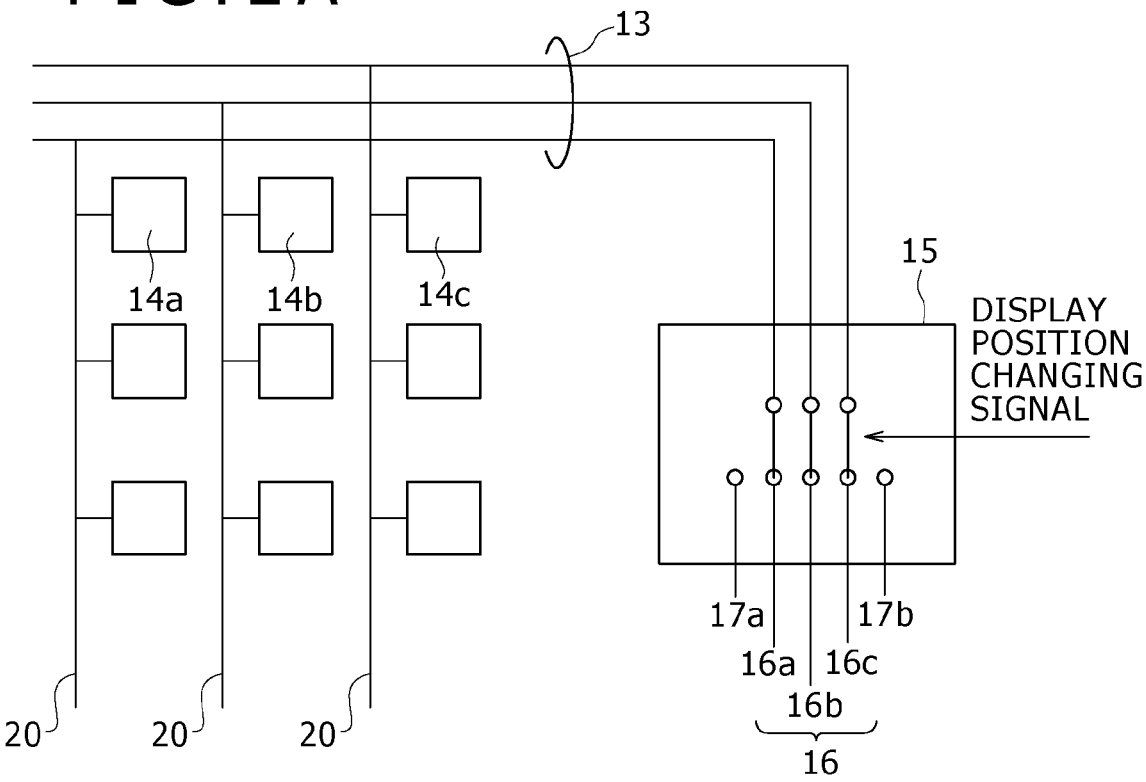
FIGS. 2A and 2B are schematic diagrams showing the structure of data lines within the liquid crystal display device.
Figure 2B:
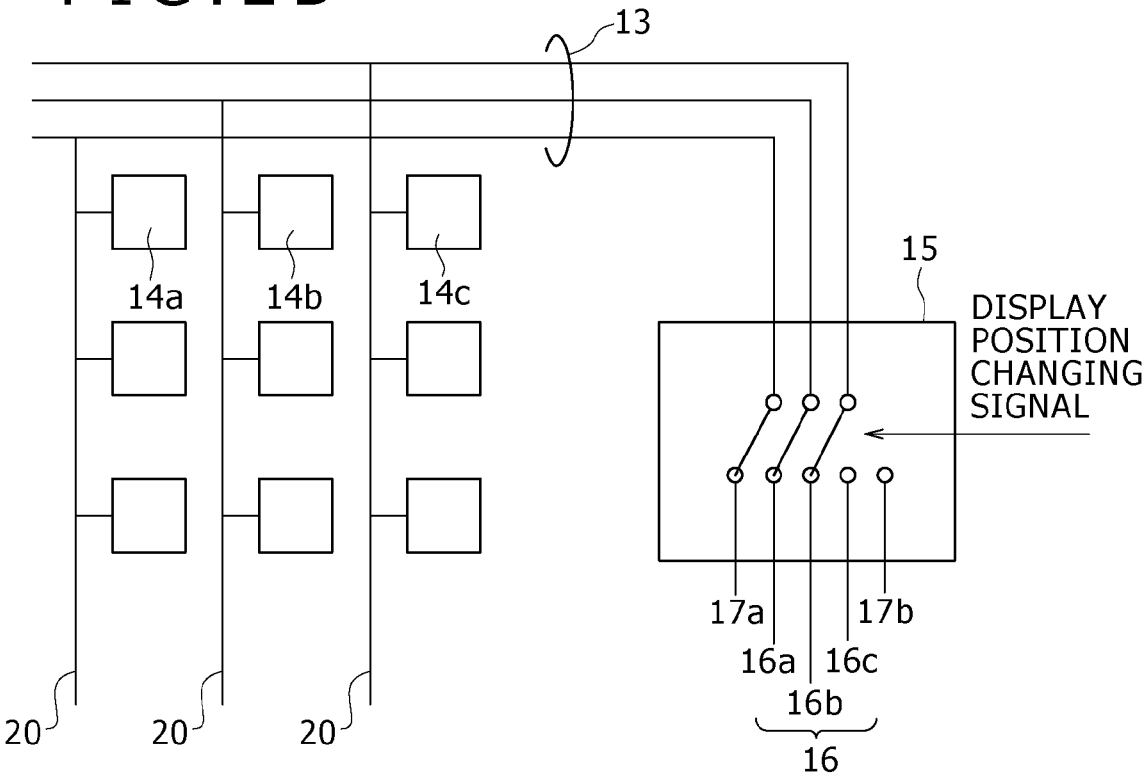

FIGS. 2A and 2B are schematic diagrams showing the structure of data lines within the liquid crystal display device. Incidentally, while wiring for three pixels along a horizontal direction of the figures is shown for simplicity of description, data lines 20 are connected to all the pixels 14 in practice.

FIG. 2A shows a state of normal connection by the switch circuit. The data lines 20 are provided one for each column (vertical direction of the figure) of pixels 14. The data lines 20 are supplied with signals from the data buses 13 connected to the output side of the switch circuit 15. The input side of the switch circuit 15 is connected with signal lines (equal in number to the number of data buses 13) 16*a* to 16*c* for signals output from the signal inputting unit 11 (see FIG. 1) and two end part wires 17*a* and 17*b*. The arrangement of the signal lines 16 corresponds to the arrangement of pixels 14. The signal line 16*a* corresponds to the column of the pixel 14*a*; the signal line 16*b* corresponds to the column of the pixel 14*b*; and the signal line 16*c* corresponds to the column of the pixel 14*c*. The signal lines 16*a* to 16*c* and the two end part wires 17*a* and 17*b* are an example of input signal lines. The data buses 13 or the data lines 20 are an example of output signal lines.

In the state of normal connection by the switch circuit 15, the signal lines 16 extending from the signal inputting unit 11 (see FIG. 1) and the data buses 13 are connected to each other such that the signal lines 16 correspond to the respective data buses 13. Thus, a signal from the signal line 16*a* is input to the column of the pixel 14*a*; a signal from the signal line 16*b* is input to the column of the pixel 14*b*; and a signal from the signal line 16*c* is input to the column of the pixel 14*c*. Image display is not shifted in this state.

On the other hand, FIG. 2B shows a state of changed connection by the switch circuit. Specifically, when a display position changing signal is externally input to the switch circuit 15, the switch circuit 15 changes from the state of normal connection to a state where the connection of the data buses 13 is shifted to adjacent signal lines 16. In the example shown in FIG. 2B, the switch circuit 15 changes the connection to adjacent signal lines 16 to the left.

As a result of this changed connection, the column of the pixel 14*a* is connected to the end part wire 17*a*, the column of the pixel 14*b* is connected to the signal line 16*a*, and the column of the pixel 14*c* is connected to the signal line 16*b*. Thus, a signal from the end part wire 17*a* is input to the column of the pixel 14*a*; a signal from the signal line 16*a* is input to the column of the pixel 14*b*; and a signal from the signal line 16*b* is input to the column of the pixel 14*c*. That is, the signals to be originally transmitted to the adjacent pixel columns to the left in the state of normal connection shown in FIG. 2A are shifted to the right by one pixel pitch and then transmitted, so that image display is shifted to the right by one pixel pitch.

In addition, though not shown, when the switch circuit 15 changes from the state of normal connection to a state where the connection of the data buses 13 is shifted to adjacent signal lines to the right, the column of the pixel 14*a* is connected to the signal line 16*b*, the column of the pixel 14*b* is connected to the signal line 16*c*, and the column of the pixel 14*c* is connected to the end part wire 17*b*. Thus, a signal from the signal line 16*b* is input to the column of the pixel 14*a*; a signal from the signal line 16*c* is input to the column of the pixel 14*b*; and a signal from the end part wire 17*b* is input to the column of the pixel 14*c*. That is, the signals to be originally transmitted to the adjacent pixel columns to the right in the state of normal connection shown in FIG. 2A are shifted to the left by one pixel pitch and then transmitted, so that image display is shifted to the left by one pixel pitch.

Incidentally, the end part wires 17*a* and 17*b* are supplied with a certain voltage or grounded, and pixels 14 connected to the end part wires 17*a* and 17*b* do not make image display. The number of columns of pixels 14 is set larger than a specified number of pixel columns by at least a number of columns by which image display is shifted, so that an image of an end part to which the image display is shifted can be displayed.

The switch circuit 15 shown in FIG. 2 can change the state of normal connection by one pixel pitch to the left or to the right. However, when the switch circuit 15 is configured to be able to change the state of normal connection more, the state of normal connection can be changed by a plurality of pixel pitches. That is, a difference between the number of input signal lines and the number of output signal lines may be two or more.

Figure 3A:
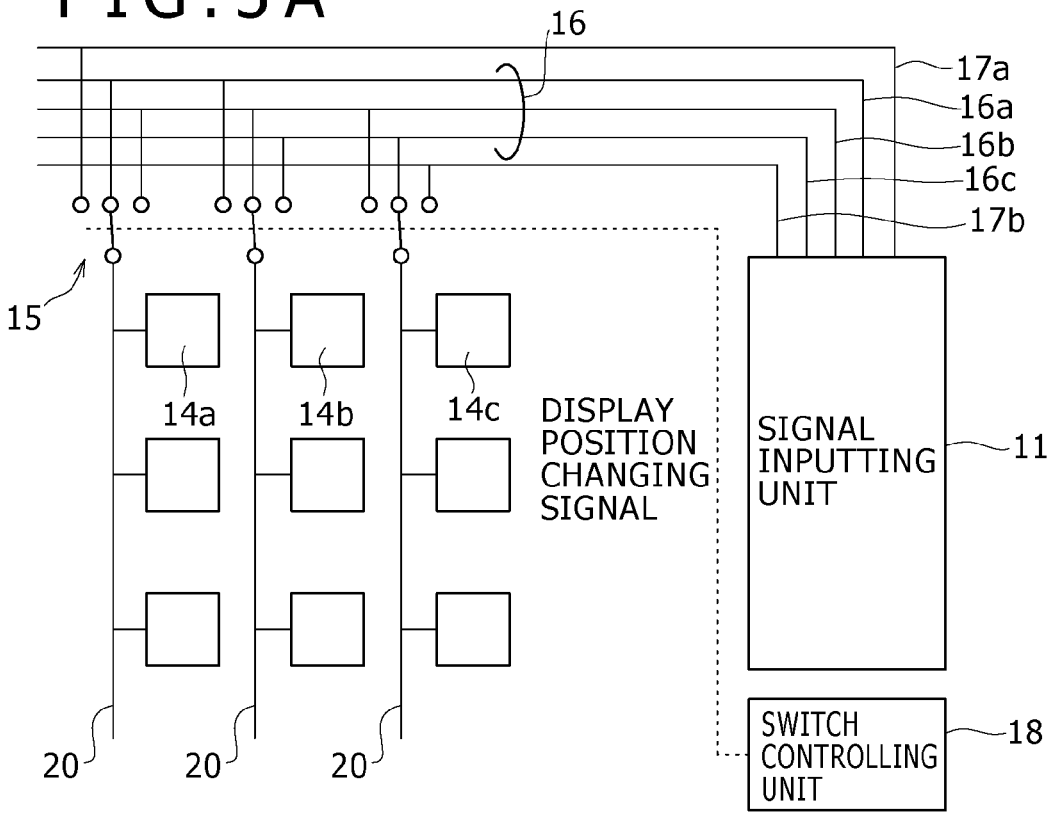
FIGS. 3A and 3B are schematic diagrams showing another example of a switch circuit.
Figure 3B:
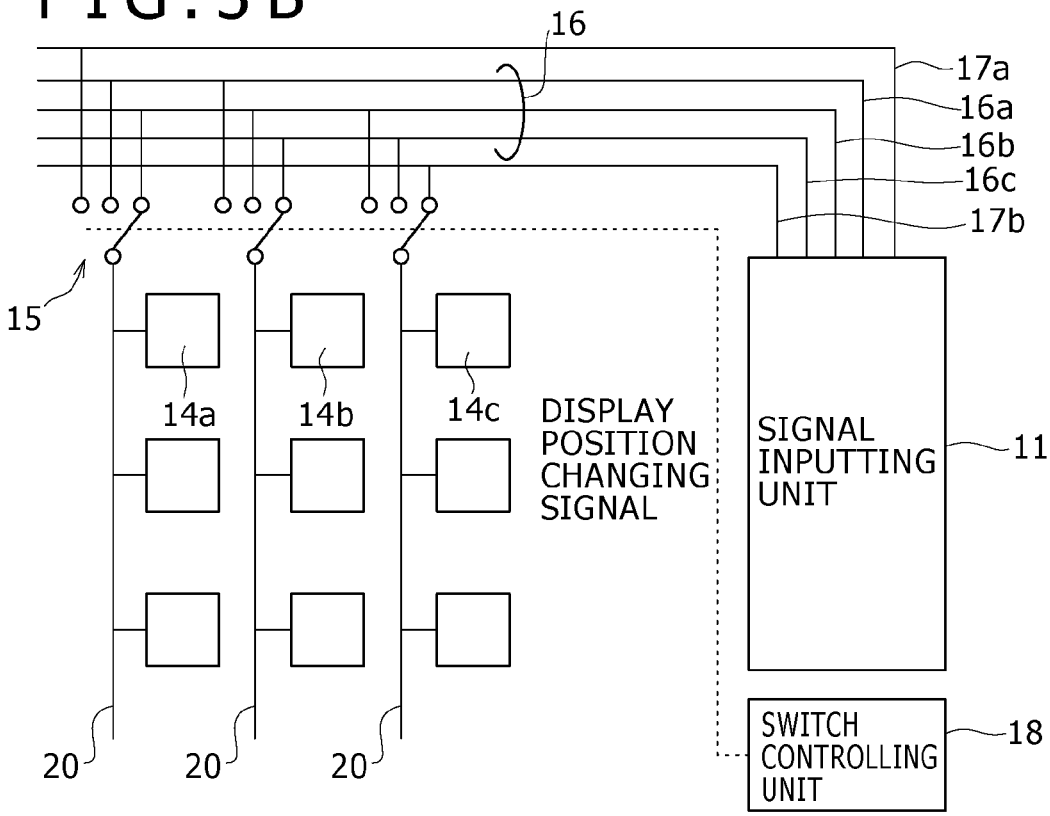

FIGS. 3A and 3B are schematic diagrams showing another example of the switch circuit. Incidentally, also in this case, while wiring for three pixels along a horizontal direction of the figures is shown for simplicity of description, data lines are connected to all pixels in practice.

In the example of the switch circuit shown in FIGS. 3A and 3B, each of data lines 20 connected to the pixels 14 can be connected to three data buses by the switch circuit 15. A display position changing signal is externally input to select one of the three data buses.

Specifically, as wiring extending from the signal inputting unit 11, the signal lines 16*a* to 16*c* corresponding to the columns of the pixels 14 are supplied with image signals as in the data buses 13, and the end part wires 17*a* and 17*b* are supplied with a certain voltage or grounded. The switch circuit 15 can select one of a total of three lines, that is, a signal line corresponding to one column of pixels 14 and signal lines or a signal line and an end part wire on the left and on the right with the signal line corresponding to the column at a center. The switch circuit 15 is controlled by the display position changing signal from a switch controlling unit 18.

First, as shown in FIG. 3A, in a state of normal connection, the switch circuit 15 selects and uses center signal lines to feed data into the pixels 14. Thus, a signal from the signal line 16*a* is input to the column of the pixel 14*a*; a signal from the signal line 16*b* is input to the column of the pixel 14*b*; and a signal from the signal line 16*c* is input to the column of the pixel 14*c*. Image display is not shifted in this state.

Next, when a signal to change the display position of an image to the left (display position changing signal) is externally input to the switch circuit 15 in certain timing, switches of all data lines are changed as shown in FIG. 3B, so that the data lines are supplied with the signals originally supplied to the data lines on the right. Specifically, a signal from the signal line 16*b* is input to the column of the pixel 14*a*; a signal from the signal line 16*c* is input to the column of the pixel 14*b*; and a signal from the end part wire 17*b* is input to the column of the pixel 14*c*. As a result, the display position of the image is shifted to the left by one pixel pitch.

When a signal to change the display position of an image to the right (display position changing signal) is externally input to the switch circuit 15, though not shown, the switch circuit 15 is changed in a manner opposite to the above, so that the pixels 14 are supplied with the signals originally supplied to the data lines on the left. Specifically, a signal from the end part wire 17*a* is input to the column of the pixel 14*a*; a signal from the signal line 16*a* is input to the column of the pixel 14*b*; and a signal from the signal line 16*b* is input to the column of the pixel 14*c*. As a result, the display position of the image is shifted to the right by one pixel pitch.

Thus, the image display device according to the present embodiment can shift the display position of the image by the simple switch circuit 15 and wiring without involving the addition of a complex driver circuit or substantial changes, and can readily correct a shift in attachment position of the image display device by shifting image display.

Incidentally, in the above-described embodiment, description has been made of examples of image shifts along the horizontal direction of the pixels 14. However, image shifts along the vertical direction of the pixels 14 may be performed by changing a similar switch circuit. In addition, a shift in one of the vertical direction and the horizontal direction of the image may be performed by the switch circuit, and a shift in the other direction may be performed by adjusting timing of signal supply from the driver circuit.

Figure 4:
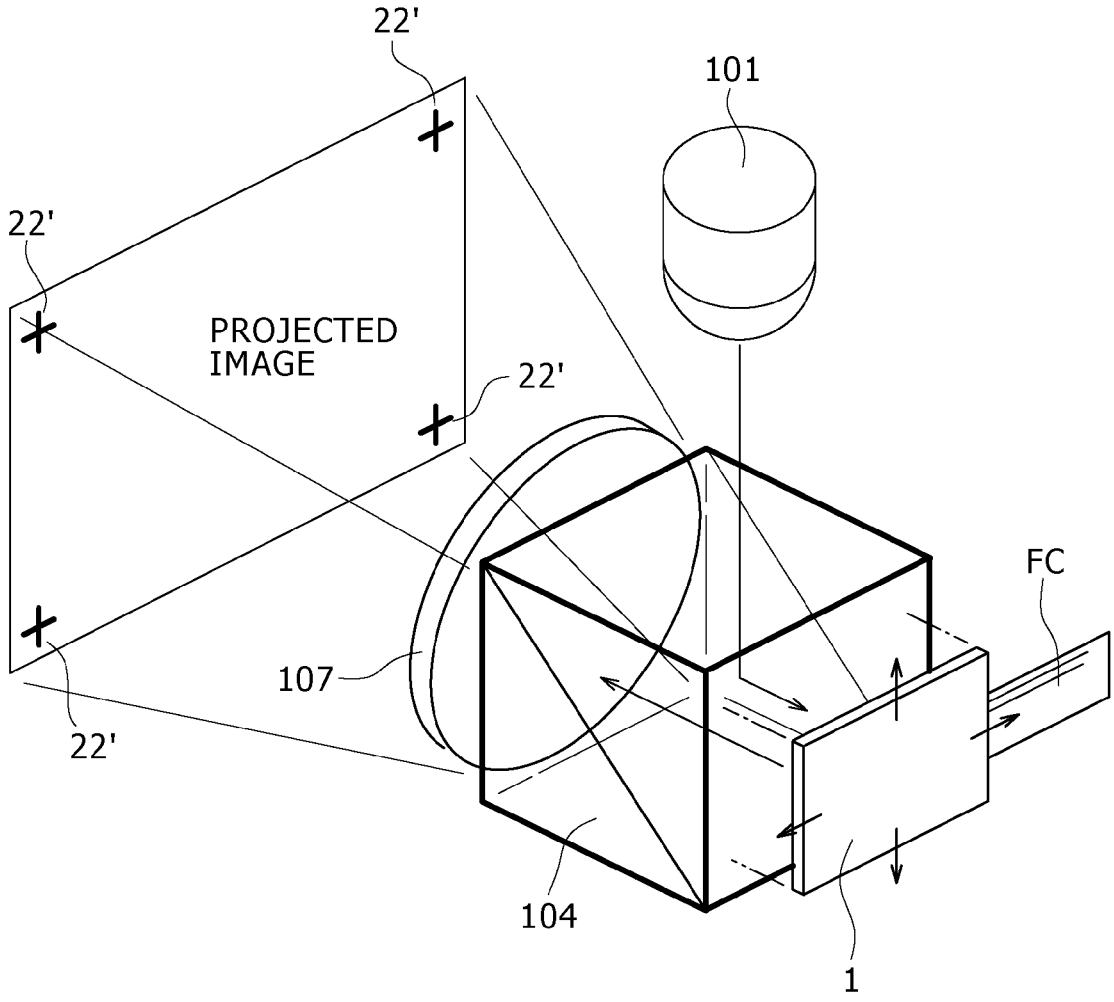
FIG. 4 is a schematic diagram of assistance in explaining a registration method.

The registration of a concrete image display device will be described in the following. FIG. 4 is a schematic diagram of assistance in explaining a registration method. In this example, the liquid crystal display device 1 is shown being registered with a beam splitter 104 as a part of an optical system. In order to attach the liquid crystal display device 1 to the reference position of the beam splitter 104, the liquid crystal display device 1 is supplied with a predetermined reference image signal to display a reference image.

When light from a lamp light source 101 is made incident on the liquid crystal display device 1 in this state, the reference image (a picture of marks 22' in this case) is enlarged and projected via a projection lens 107. With the projected picture of the marks 22' as a reference, the liquid crystal display device 1 is adjusted in position and then attached to the beam splitter 104.

When the liquid crystal display device 1 is fixed to the beam splitter 104, a slight positional displacement at the time of fixing the liquid crystal display device 1 may occur. In order to correct a shift in image display position due to the positional displacement, the image display position is shifted by a display position changing signal supplied to the above-described switch circuit.

Incidentally, with a three-panel type liquid crystal projector, liquid crystal display devices corresponding to three colors R, G, and B are registered. In this case, the configuration for adjustment shown in FIG. 4 is provided for three liquid crystal display devices, and the reference images of the three liquid crystal display devices are displayed simultaneously. Pictures of marks as the reference images of the three liquid crystal display devices are superimposed on each other in a projected image. The arrangement of the liquid crystal display devices is adjusted such that the marks precisely coincide with each other. When image display is shifted in some direction by inputting a display position changing signal to the switch circuit after fixation, high-quality color video can be obtained with a registration displacement after the fixation corrected.

Figure 5:
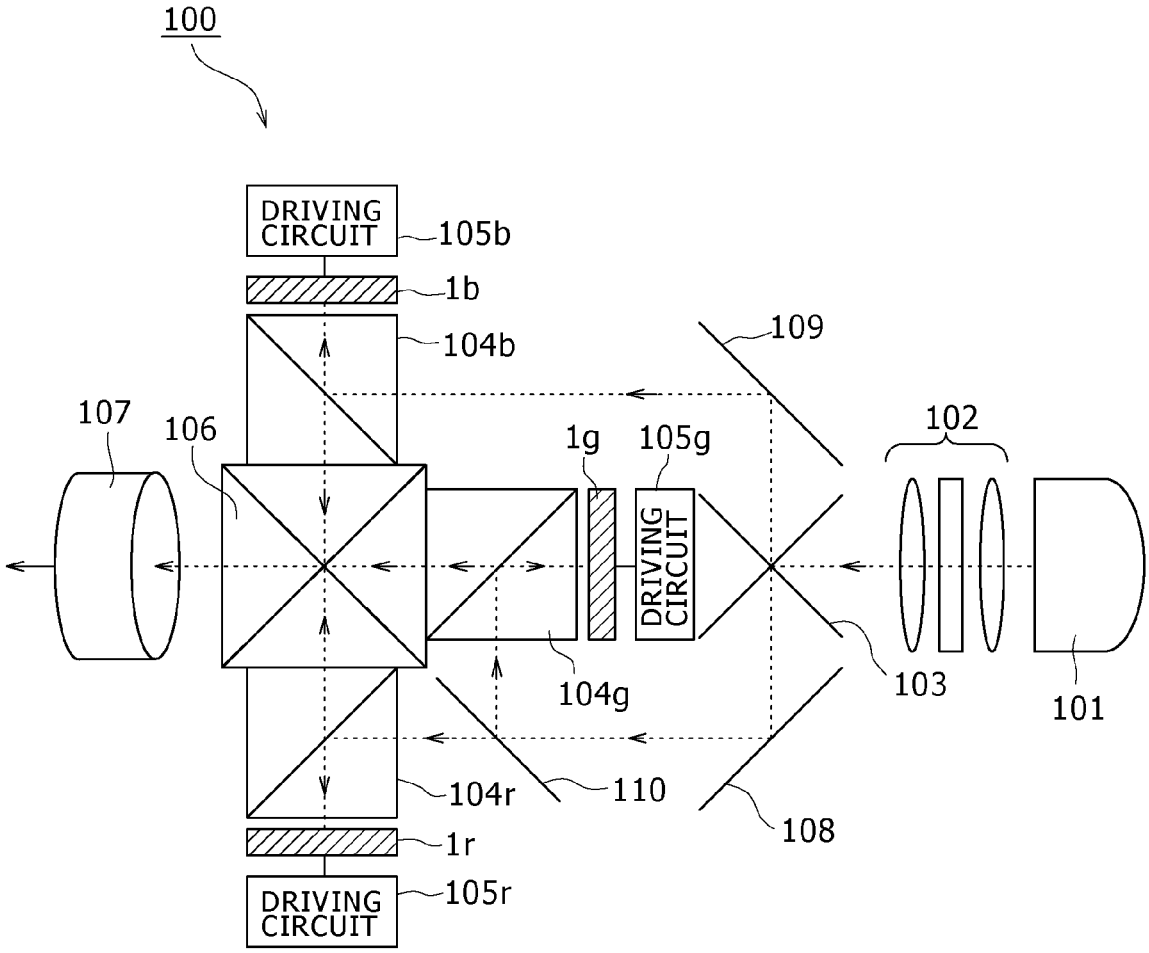
FIG. 5 is a schematic diagram showing an example of a projection system using the liquid crystal display device according to the present embodiment.

It is desirable to apply the liquid crystal display device 1 according to the present embodiment to for example a projection system (liquid crystal projector) requiring the registration of a plurality of liquid crystal panels (liquid crystal display devices 1). FIG. 5 is a schematic diagram showing an example of a projection system using the liquid crystal display device according to the present embodiment. Specifically, the projection system 100 includes a lamp light source 101, a lens part 102, a dichroic color separation filter 103, beam splitters 104*r*, 104*g*, and 104*b*, liquid crystal display devices 1*r*, 1*g*, and 1*b*, driving circuits 105*r*, 105*g*, and 105*b*, a prism (dichroic mirror) 106, and a projection lens 107. The reflective type liquid crystal display device according to the present embodiment described above is used as the liquid crystal display devices 1*r*, 1*g*, and 1*b*.

In this system, light emitted from the lamp light source 101 is transmitted from the lens part 102 to the dichroic color separation filter 103, where the light is separated in two directions. The pieces of the light separated in the two directions are transmitted to display parts formed by the reflective type liquid crystal display devices 1*r*, 1*g*, and 1*b* corresponding to three colors R (RED), G (GREEN), and B (BLUE) by total reflection mirrors 108 and 109, the beam splitters 104*r*, 104*g*, and 104*b*, a dichroic mirror 110, and the prism 106.

For example, the light from the lamp light source 101 enters the liquid crystal display device 1*r* corresponding to the color R (RED) via the dichroic color separation filter 103, the total reflection mirror 108, and the beam splitter 104*r*. The light from the lamp light source 101 enters the liquid crystal display device 1*g* corresponding to the color G (GREEN) via the dichroic color separation filter 103, the total reflection mirror 108, the dichroic mirror 110, and the beam splitter 104*g*. The light from the lamp light source 101 enters the liquid crystal display device 1*b* corresponding to the color B (BLUE) via the dichroic color separation filter 103, the total reflection mirror 109, and the beam splitter 104*b*.

The liquid crystal display devices 1*r*, 1*g*, and 1*b* are provided in a state of respectively corresponding to a plurality of surfaces of the prism 106 as a dichroic mirror with the beam splitters 104*r*, 104*g*, and 104*b* interposed between the liquid crystal display devices 1*r*, 1*g*, and 1*b* and the plurality of surfaces of the prism 106. The liquid crystal display devices 1*r*, 1*g*, and 1*b* are driven by the driving circuits 105*r*, 105*g*, and 105*b* respectively corresponding to the liquid crystal display devices 1*r*, 1*g*, and 1*b*. The liquid crystal display devices 1*r*, 1*g*, and 1*b* convert the incident light into images in liquid crystal layers, and then reflect the images. The prism 106 as light synthesizing means synthesizes the images, and transmits the result to the projection lens 107. Thereby, the images corresponding to the three colors R (RED), G (GREEN), and B (BLUE) are projected on a screen not shown in the figure, and thus reproduced as a color image.

When the liquid crystal display device 1 (1*r*, 1*g*, and 1*b*) according to the present embodiment is used in such a liquid crystal projector, the images of the liquid crystal display devices 1 (1*r*, 1*g*, and 1*b*) can be precisely registered with each other without special driving circuits being used.

In addition, since the liquid crystal display device 1 according to the present embodiment enables registration even after fixation to the prism 106, an attachment precision at the time of the fixation can be lowered. Further, in order to obtain an image without a color shift using pictures of different colors output from a plurality of display devices, the output light of the different colors needs to be registered within a precision of one pixel. The liquid crystal display device 1 according to the present embodiment enables a shift of at least one pixel in the left direction or the right direction from an original display position. Therefore, even when the attachment position is shifted by about one pixel in the left direction or the right direction, the display position can be corrected so as to prevent a color shift. It is thus possible to lower registration accuracy and expect a reduction in cycle time and an improvement in yield.

Further, the liquid crystal display device 1 according to the present embodiment has a great advantage of allowing a positional displacement to be corrected after attachment to the prism 106. That is, even when attachment precision can be increased, a displacement can occur after actual attachment. Even in this case, the display position can be changed without the display device being detached, so that an improvement in yield can be expected.

Moreover, when an amount of displacement of the display position is barely within specifications, an amount of color shift can be further reduced by shifting the display position. Thus, even higher image quality can be achieved. As described above, the present embodiment can contribute to an improvement in product yield and an improvement in image quality of the product. In addition, the present embodiment makes it possible to provide the product at low cost.

The image display device according to the present embodiment is applicable to other than reflective type liquid crystal display devices. For example, the image display device according to the present embodiment is applicable to display devices capable of display driving in pixel units, such as a digital micromirror device in which a pixel has a micromirror configuration, the orientation of a mirror is changed by an input signal, and reflected light is turned on and off rapidly to express gradation in an active matrix type display device having a substrate whose surface is divided in the form of a matrix, each divided part forming a pixel, an organic EL display device, a plasma display device, and a transmissive type liquid crystal display device. In addition, the image display device according to the present embodiment is applicable to a projection type video display device in which two or four image display devices according to the present embodiment (including the above-described liquid crystal display devices, the digital micromirror device, the organic EL display device, the plasma display device, and the like) are attached to light synthesizing means.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device comprising:

a pixel group formed by arranging a plurality of pixels;

a driver circuit configured to supply an image signal to each pixel in said pixel group; and a switch circuit configured to shift a destination to which said image signal is supplied in a unit of a pixel pitch by switching bus lines for transmitting said image signal from said driver circuit to each pixel in said pixel group.

2. The image display device as claimed in claim 1, wherein said switch circuit is included in said driver circuit.

3. The image display device as claimed in claim 1, wherein a difference between a number of input signal lines and a number of output signal lines in said switch circuit is two or more.

4. The image display device as claimed in claim 1, wherein when the plurality of pixels of said pixel group are arranged in a form of a matrix, said switch circuit performs switching for one of a group of pixel columns in a vertical direction and a group of pixel columns in a horizontal direction.

5. The image display device as claimed in claim 1, wherein when the plurality of pixels of said pixel group are arranged in a form of a matrix, said switch circuit performs switching for one of a group of pixel columns in a vertical direction and a group of pixel columns in a horizontal direction, and timing of supplying the image signal from said driver circuit is adjusted for the other group.

* * * * *